US005842422A

United States Patent [19]

Bishop

[11] Patent Number: 5,842,422

[45] Date of Patent: Dec. 1, 1998

[54] RAILWAY TRACK

[76] Inventor: Arthur Ernest Bishop, 15c Avon Road, Corner Barr Street, North Ryde, Australia, NSW 2113

[21] Appl. No.: 817,608

[22] PCT Filed: Oct. 18, 1995

[86] PCT No.: PCT/AU95/00689

§ 371 Date: Jul. 11, 1997

§ 102(e) Date: Jul. 11, 1997

[87] PCT Pub. No.: WO96/12852

PCT Pub. Date: May 2, 1996

[30] Foreign Application Priority Data

Oct. 20, 1994 [AU] Australia ..... PM8942

[51] Int. Cl.[6] ..... E01B 25/00

[52] U.S. Cl. ..... 104/244; 104/246; 238/382; 238/336; 238/338

[58] Field of Search ..... 104/244, 246; 238/122, 264, 283, 292, 310, 336, 342, 382, 338

[56] References Cited

U.S. PATENT DOCUMENTS

| | | | |
|---|---|---|---|
| 2,670,136 | 2/1954 | Moses | 238/382 |
| 3,358,927 | 12/1967 | Hein et al. | 238/283 |
| 3,417,922 | 12/1968 | Vaulry | 238/292 |
| 3,525,472 | 8/1970 | Sato | 238/382 |
| 4,216,904 | 8/1980 | Vivion | 238/382 |
| 4,775,103 | 10/1988 | Ortwein | 238/336 |
| 5,165,598 | 11/1992 | Ortwein | 238/336 |

FOREIGN PATENT DOCUMENTS

| | | | |
|---|---|---|---|
| 60099/65 | 12/1966 | Australia . | |
| 36360/68 | 10/1969 | Australia . | |
| 53777/73 | 10/1974 | Australia . | |
| 42526/78 | 6/1979 | Australia . | |
| 70109/87 | 9/1988 | Australia . | |
| 1301124 | 7/1962 | France | 238/382 |
| 359727 | 9/1922 | Germany . | |
| 1904683 | 8/1970 | Germany . | |
| 2603001 | 7/1977 | Germany . | |
| 2807984 | 8/1978 | Germany . | |
| 1199897 | 7/1970 | United Kingdom . | |
| 93/25757 | 12/1993 | WIPO . | |
| 94/18048 | 8/1994 | WIPO . | |
| 94/23980 | 10/1994 | WIPO . | |

*Primary Examiner*—Mark Tuan Le
*Attorney, Agent, or Firm*—Spencer & Frank

[57] ABSTRACT

In a vehicle track having longitudinal rail members positioned in parallel on either side of a track centerline and on which respective drive wheels and guide wheels of a vehicle move, the improvement including longitudinal rail members each having an asymmetrical cross-section and being composed of a head portion having a primary upper running face which engages the periphery of the drive wheel, a lower guide face opposed to the primary upper running face which engages the guide wheel, and a secondary running face which is substantially vertical, which is located inwardly of the head portion towards the track centerline, and which engages the flange of the drive wheel; and a leg portion extending downwardly from the head portion; and a plurality of track support members arranged at intervals along the vehicle track and composed of a clamp device having first and second clamp faces which are moveable, which are juxtaposed to the leg portion one on each side thereof, which grip the leg portion, and which each incorporate a resilient element comprised of elastomeric material interposed between the leg portion and the respective clamp face.

8 Claims, 4 Drawing Sheets

RAILWAY TRACK

BACKGROUND OF THE INVENTION

1. Field of the Invention

The present invention is related to a railway track for an automated guided vehicle system. Whilst the invention is, according to one embodiment, directed towards and primarily described with reference to such systems, it is considered that the invention is suitable for use with other guided vehicle systems used, for example, for freight transportation or materials handling. The invention in a preferred form relates to the reduction of noise during operation of such systems.

2. Description of the Related Art

An automated guideway system of the above type is described in co-pending PCT Application No. PCT/AU94/00201 entitled "Rail Gripping Vehicle". As described therein, such a system utilising individual vehicles which each accommodate, for example, between eight and twenty-five passengers would typically operate on guideways separated from other vehicular traffic and pedestrians. Such guideways will preferably be narrow, elevated above street level and supported on pillars, an arrangement often referred to as a monorail. The system should desirably operate with low noise and vibration levels. Preferably, the vehicles should descend and ascend on ramps from guideways to the street level and be capable of very short emergency stopping distances if they are to operate safely at high speeds and close intervals.

Generally, in systems of the type referred to, vehicles have pneumatic tire wheels which operate directly on the concrete or other guideway surface, and are therefore acceptably quiet. However, their stopping and grade climbing ability is unsatisfactory as is also their maximum speed. The guideways are frequently unacceptably wide.

In order to meet the various requirements referred to above, the system described in the above referenced PCT application employs steel wheels on the vehicles operating on narrow track steel rails; secondary rail gripping wheels which press on the underside of the railhead running face are used so increasing the grip of the main wheels on the rails in order to meet the necessary accelerating, braking, and ramp climbing capabilities. These wheels need only be engaged when slippage of the main drive wheels is likely, and at other times remain slightly clear of the rail surface. In such a position they guard against possible derailment of the vehicle in high winds or other disturbances which can prove hazardous for narrow gauge systems. However, attention has to be paid to minimising noise and vibration inevitably associated with the use of steel wheels. Such noise is particularly apparent when the vehicle is traversing curved track due to contact between the wheel flanges and the rail. This aspect of the problem is addressed in the co-pending PCT Application AU95/00046 "Self Steering Railway Bogie" which describes an arrangement which greatly reduces flange contact, even in small radius curves. A feature of that invention is the use of steeply inclined wheel axes and rail running faces to produce the steering action.

The rumbling sound which originates in slight rail and wheel surface irregularities and in the drive system, both in curved and straight track, also needs to be considered. This problem occurs in conventional light railways and street cars using steel wheels and rails, and it is common practice to incorporate rubber pads in the wheels to reduce the transmission of contact noise from the wheel rims to the wheel disk from which it is radiated. This principle is also adopted in the present invention.

Such noise is also transmitted to the rails, and it is accepted railway practice to stand the rails on base plates insulated from the track foundation by resilient mountings as illustrated in AU42628/78 (531212)B (Duchemin).

SUMMARY OF THE INVENTION

The present invention consists in a longitudinal rail member for a vehicle track in combination with a plurality of track support members arranged at intervals along the track, the rail member comprising a head portion having a primary upper running face and a substantially vertical secondary running face located inwardly of the rail head towards the track centreline adapted to engage respectively the periphery and flange of the vehicle wheel, said head portion having a lower guide face opposed to said primary upper running face and a leg portion extending downwardly from said head portion substantially adjacent to said secondary running face characterised in that each said support member has clamp means having first and second relatively movable faces juxtaposed one on each side of said leg portion, adapted to grip said leg portion, each face incorporating a resilient elastomeric material element interposed between said leg portion and said face.

Preferably the elastomeric material is substantially faced with a metal liner which engages with the leg portion of the rail.

Preferably the leg portion of the rail has a foot portion for engagement of the track support members.

In a second aspect the invention comprises a rail having an upper face for the main wheels to run on, a lower opposed face for the grip wheel to run on, and a substantially vertical face for the flange of the main wheel set to engage. The above faces are grouped together in close proximity and incorporated in the head of the rail. Preferably they are arranged in the form of a ledge which extends outwardly with respect to the track centreline from the body of the rail which takes the form of a downwardly extending leg attached to brackets spaced along the track. The means of attachment includes clamp jaws, one on each side of the leg of the rail each lined with a resilient material such as rubber.

Such an arrangement allows the resilient material to be located well up the leg itself and adjacent to the underside of the rail head so that the resilient material is loaded in shear rather than in compression with respect to the vertical loads, and hence may be relatively soft, yet is loaded in compression with respect to the lateral load and hence is relatively rigid. Because of the small vertical offset between the rail head and the resilient material, side forces applied to the rail head such as from wheel flange contact produce only small deflections, particularly as the material is in compression in the lateral direction.

Thus the arrangement shown in Duchemin, which is typical of the practice widely used to suppress noise in main line railway practice, is totally unsuited to use in the small, rail gripping vehicle to which the present invention relates. A relatively more resilient mount is required to suppress the vibrations which originate not only in the main wheels but also in the grip wheels. Note that the rail has to be of about the same height as in the case of the main line rail in order to provide clearance so that the underslung grip wheels in order that they clear the sleepers. Furthermore, if a flange were used at the bottom of the rail web or leg, it could only extend inwardly, for the same reason. A resilient mount placed so far below the head of the rail and so far offset from the plane in which the rail head forces (i.e., the normal force at wheel contact, and flange forces, if any) are aligned, would result in the two rails splaying apart under load.

A preferred arrangement is to employ at regular intervals along the track a shoe or bracket rigidly secured to the guideway or track foundation which has a face which is inwardly inclined towards the centre of the track to match the angle of the leg of the rail. To this face is bonded a rubber insulating layer of substantially uniform thickness arranged to bear directly on the outer face of the rail leg. The bracket extends inwardly horizontally towards the centre of the track to provide a guide for a wedge clamp piece also having an insulating layer of rubber bonded to its face which bears directly on the inner face of the rail leg. One or more clamp bolts passing the apex of the wedge clamp serve to apply considerable pressure to the rubber insulating layers to inhibit the longitudinal sliding of the rail. By putting the rubber bond under compressive stress it is less likely to progressively separate from the surface to which it is bonded, a precautionary measure which is well known in the art. The bonded layer of rubber on the bracket may extend around and underneath an enlarged foot of the rail leg so that it cannot move downwardly more than the amount permitted by the shear of the bonded rubber layer.

Because the leg portion of the rail is laterally offset from the ledge portion, it can be somewhat shorter than if it had to extend below the bottom of the secondary wheel, thus minimising the area of the rail exposed to the air and hence the degree to which noise originating in rail-wheel contact is radiated to the air.

In a still further embodiment, thin sheet metal plates are bonded to the inner faces of the rubber isolation blocks to avoid direct contact between them and the rail leg. The sheet metal plate of the bracket is bent around so as to neatly conform to the enlarged foot of the rail leg.

BRIEF DESCRIPTION OF THE DRAWINGS

In order that the invention may be better understood a preferred form thereof is hereinafter described, by way of example, with reference to the accompanying drawings, in which.

DESCRIPTION OF THE PREFERRED EMBODIMENTS

Figure 1:
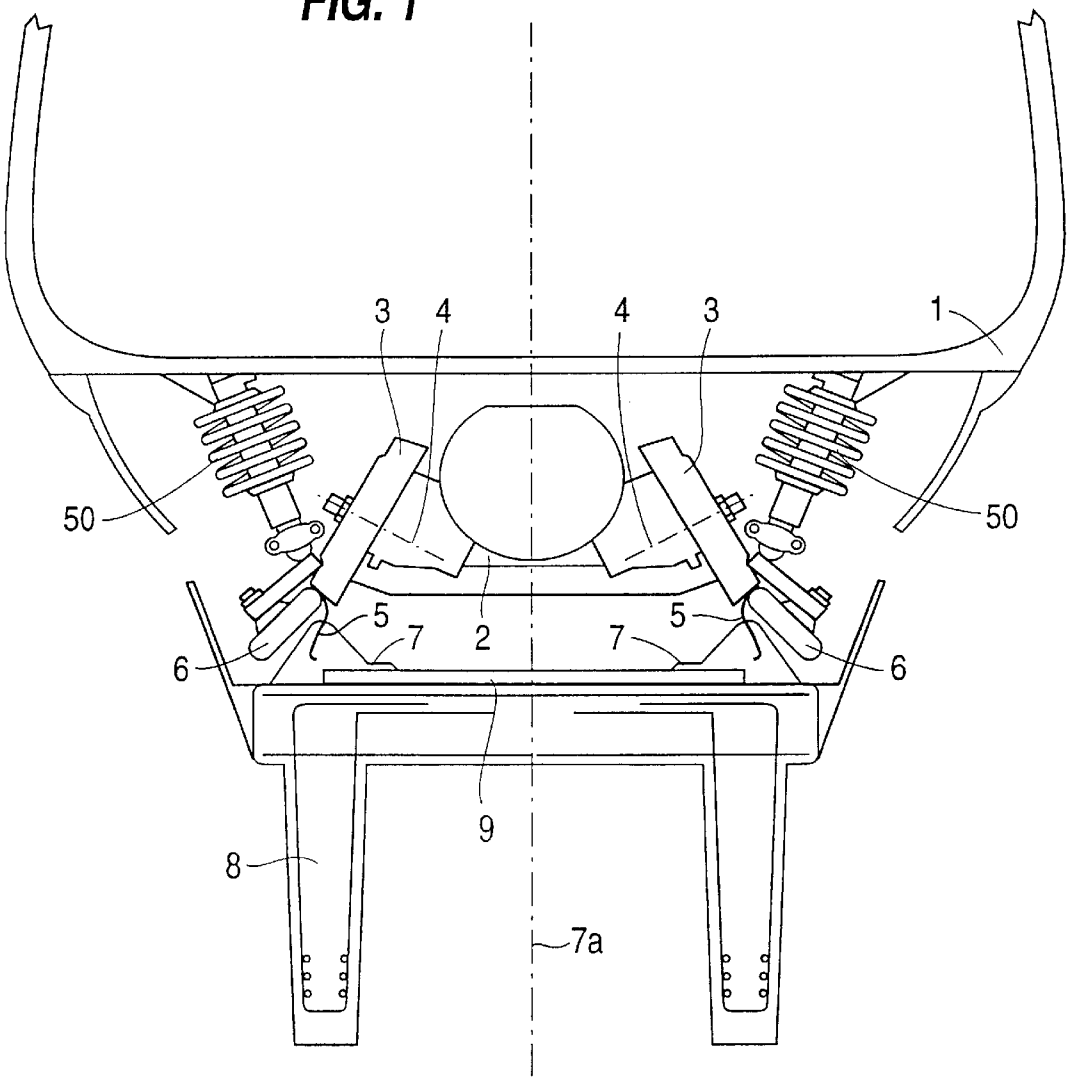
FIG. 1 shows a cross-sectional elevation through a guideway and rails, and an end view of a bogie arrangement.

FIG. 1 shows the general features of a vehicle bogie and track according to one aspect of the invention. Vehicle 1 is supported on bogie 2 by suspension members 50, which include linkages for the control of the relative lateral, longitudinal and roll motions.

Figure 2:
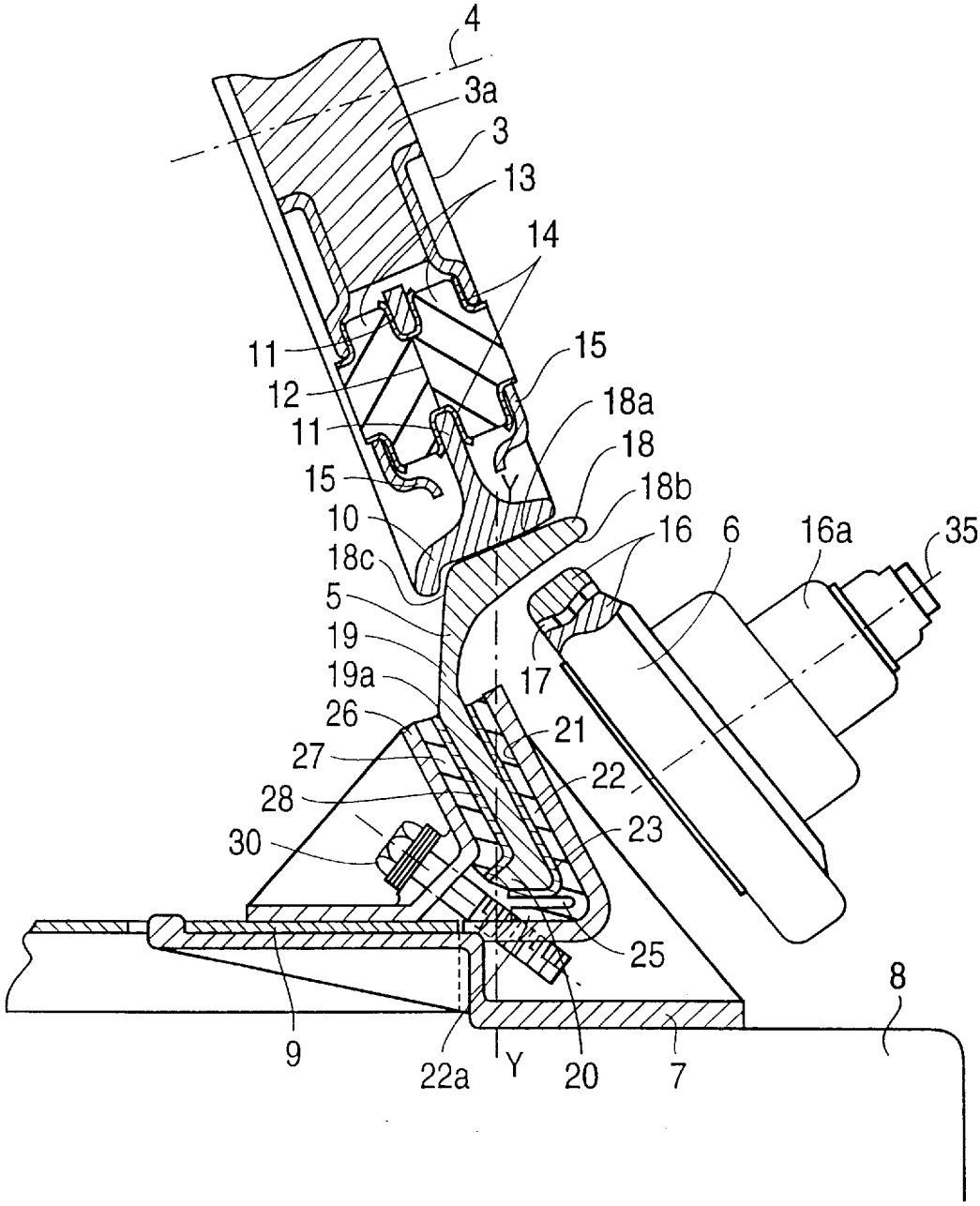
FIG. 2 shows an enlarged part-sectional view of the wheels, rail, rail support bracket and tie.

Main drive wheels 3 rotate on axles whose axes 4 are inclined to the horizontal and engage the upper face of rails 5 which are provided with upper and lower inclined running faces. In FIG. 2 axes 4 of main drive wheels 3 are inclined to the horizontal about 20 degrees. It should be noted however, that inclination in the range of 10 to 30 degrees may be employed when used in conjunction with the "Self Steering Railway Bogie" of PCT/AU94/00046.

In FIG. 2 grip wheel 6 is shown disengaged from the lower running face of the rail 5, but may be raised to press thereon as described in PCT Application No. AU94/00201 in order to increase the grip of the main wheel 3 on rail 5 during grade climbing or emergency braking.

Rail 5 is clamped in bracket 7 secured to guideway beam 8 by bolts 51 (see FIG. 3) symmetrically about track centreline 7*a* and is maintained at a correct spacing by sheet metal tie 9.

Referring now to FIG. 2, wheel 3 having axis 4 comprises rim 10 which incorporates disc hub 11 having an array of holes 12 therein for retention of circular rubber damping members 13 which are for convenience, bonded to sheet metal sheathing cups 14. At their outer extremities parallel to axis 4, cups 14 enter wheel flange member 15 secured to hub 3*a* of wheel 3. This construction of a drive wheel is well known in the art, for example UK Patent No. 1,199,897.

Similarly, grip wheel 6 which rotates freely on an axle of axis 35, comprises rim 16, rubber isolating ring 17 and hub 16*a,* as is well known in the art.

Rail 5 comprises ledge (or head) portion 18, leg 19 and foot 20 and according to the arrangement shown, it is firmly gripped in bracket 7 which is provided with an upwardly extending inwardly inclined face 21 to which is bonded a rubber isolation strip 22, which itself is bonded to sheet metal liner 23.

Ledge portion 18 has upper surface 18*a* for the main wheel 3 to run on, a lower surface 18*b* for the grip wheel 6 to run on and a substantially vertical face 18*c* for the flange of rim 10 to engage. Leg 19 incorporates a bend at 19*a* to provide clearance between grip wheel 6 and bracket 7 when the bogie is negotiating curves of small radii. Upper surface 18*a* is inclined with respect to lower surface 18*b* in order to facilitate clearance between grip wheel 6 and bracket 7.

Foot 20 of leg 19 aids in locating the rail vertically within the bracket 7. Sheet metal liner 23 is curved about foot 20 which will assist in preventing sheet metal liner 23 from moving upwardly in the clamp in the event that the bond between inclined face 27 and rubber isolation strip 22 should fail. Rubber isolation strip 22 extends into a horizontal portion 22*a* of bracket 7 and is moulded so as to allow a gap 25 to provide increasing vertical stiffness of the clamp as the downward travel of the rail under load exceeds the width of gap 25.

Wedge clamp 26 has rubber isolation strip 27 and sheet metal liner 28 bonded thereto in a manner similar to isolation strip 22 and sheet metal liner 23 of bracket 7.

Screws 30 are tightened according to a specification that determines the longitudinal force associated with slippage, which can be transmitted from rail 5 to bracket 7 before slippage occurs.

Figure 3:
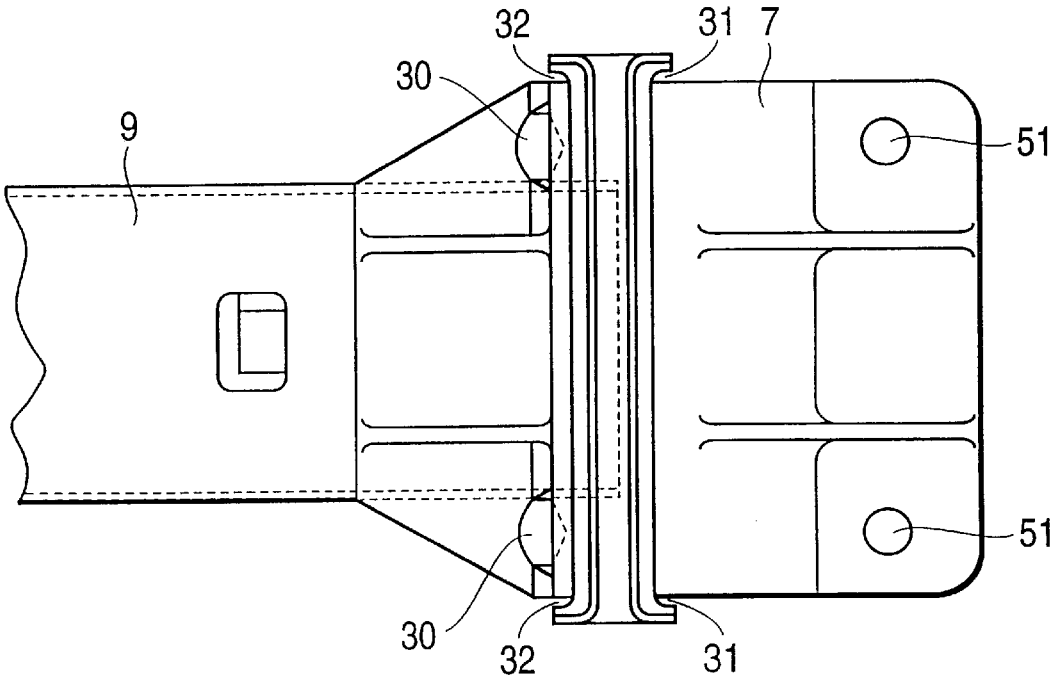
FIG. 3 is a plan view of the rail support bracket.
Figure 4:
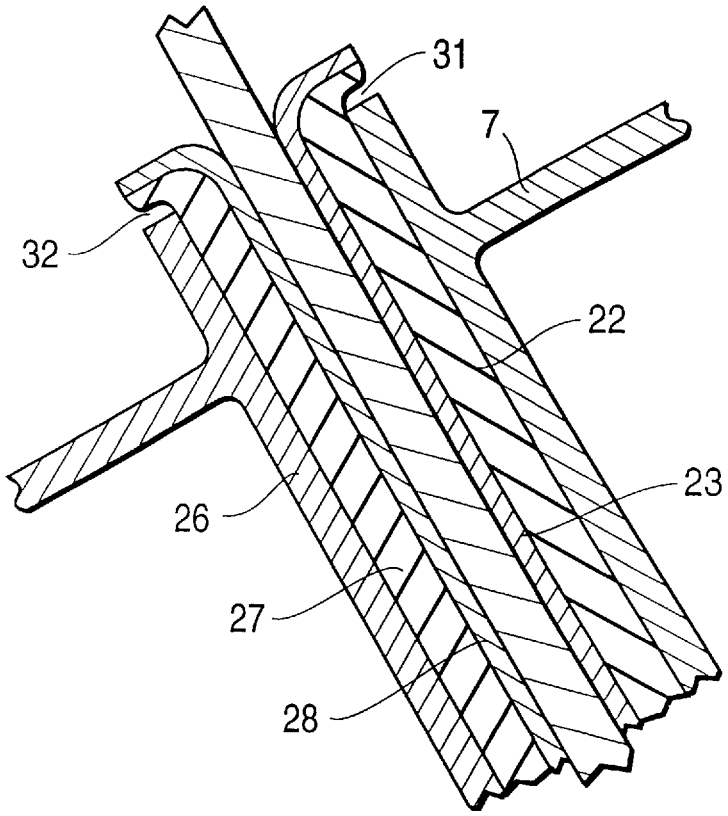
FIG. 4 is an enlarged view of Section X—X of FIG. 2.

Thus if it is desired to have rail 5 welded into continuous lengths in order to eliminate the noises associated with rail joints, then expansion and contraction forces resulting from the relative expansion of rail 5 with respect to guideway 8 must be resisted by the brackets. Such forces reach a maximum value at the ends of a long length of welded rail, for example, where a track switch occurs, and should be less than the above slippage force. The prevent such forces reaching a value that could affect the bonding of the rubber isolation strips 22 and 27, for example during periods of extreme temperatures, the ends of sheet metal liners 23 and 28 (refer to FIG. 4) are bent around at right angles at each end of bracket 7, and suitable gaps 31 and 32 are provided to limit such travel whilst still providing a resilient mounting under normal circumstances. Gaps 31 and 32 are provided at each end of bracket 7 as shown in FIG. 3.

It will be seen that both the rubber elements 22 and 27 and the sheet metal liners 23 and 28 are so configured that even in the event of a failure of the bonding occurs, they can not escape from the clamp configuration either vertically upwards or longitudinally along the direction of the track.

It should be noted that rail 5, whilst being asymmetrical in cross-section as compared to conventional rail sections, is configured such that it does not assume curvature in the vertical plane when bent in the horizontal plane; this is because the neutral axis, shown as Y—Y in FIG. 2 is vertical as installed.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

What is claimed is:

1. In a vehicle track having longitudinal rail members positioned in parallel on either side of a track centerline and on which respective drive wheels and guide wheels of a vehicle move, the improvement comprising:

longitudinal rail members each having an asymmetrical cross-section and being comprised of:

a head portion having a primary upper running face which engages the periphery of the drive wheel, a lower guide face opposed to the primary upper running face which engages the guide wheel, and a secondary running face which is substantially vertical, which is located inwardly of the head portion towards the track centerline, and which engages the flange of the drive wheel; and a leg portion extending downwardly from the head portion; and a plurality of track support members arranged at intervals along the vehicle track and comprised of clamp means having first and second clamp faces which are moveable, which are juxtaposed to the leg portion one on each side thereof, which grip the leg portion, and which each incorporate a resilient element comprised of elastomeric material interposed between the leg portion and the respective clamp face.

2. The vehicle track according to claim 1, wherein the first and second clamp faces are substantially inclined inwardly towards the centerline of the track, and wherein the primary upper running face is substantially inclined downwardly toward the centerline of the track.

3. The vehicle track according to claim 2, wherein the clamp means further comprises a metal liner provided between each respective resilient element and the leg portion, at least one of the metal liners having a transverse portion which engages a portion of the leg portion and which precluding downward movement of the leg portion with respect to the metal liner while permitting longitudinal movement therebetween.

4. The vehicle track according to claim 3, wherein the transverse portion comprises a substantially horizontal ledge extending horizontally immediately beneath the leg portion of the longitudinal rail member.

5. The vehicle track according to claim 1, wherein each of the resilient elements is faced with a metal liner where it engages the leg portion of the longitudinal rail member.

6. The vehicle track according to claim 1, wherein the resilient elements are each bonded to respective clamp faces.

7. The vehicle track according to claim 6, wherein the metal liners are provided with edge flanges which prevent movement thereof in relation to the clamp faces so that deflection of the resilient elements in the longitudinal direction of the track is substantially prevented.

8. The vehicle track according to claim 1, wherein one clamp face from among the first and second clamp faces of respective track support members is fixed and another clamp face from among the first and second clamp faces of respective track support members is movable.

* * * * *